US007762294B2

(12) United States Patent
Wang

(10) Patent No.: US 7,762,294 B2
(45) Date of Patent: Jul. 27, 2010

(54) REVERSIBLE TOTE BAG

(75) Inventor: San Chyi Wang, New York, NY (US)

(73) Assignee: Tumi, Inc., South Plainfield, NJ (US)

( * ) Notice: Subject to any disclaimer, the term of this patent is extended or adjusted under 35 U.S.C. 154(b) by 305 days.

(21) Appl. No.: 11/881,466

(22) Filed: Jul. 27, 2007

(65) Prior Publication Data

US 2009/0026240 A1 Jan. 29, 2009

(51) Int. Cl.
*A45C 13/22* (2006.01)
*A45C 13/30* (2006.01)

(52) U.S. Cl. ..... 150/104; 150/107; 150/113; 190/110; 190/116; 383/13

(58) Field of Classification Search ..... 150/103–108, 150/118, 113; 190/116, 110; 383/4, 6, 13, 383/105; 16/125, 425
See application file for complete search history.

(56) References Cited

U.S. PATENT DOCUMENTS

| | | | | | |
|---|---|---|---|---|---|
| 1,003,920 | A * | 9/1911 | Kuhn | 150/107 |
| 1,239,130 | A * | 9/1917 | Schuman | 190/116 |
| 1,468,711 | A * | 9/1923 | Dwyer | 383/6 |
| 1,960,396 | A * | 5/1934 | Rosenberg | 150/105 |
| 2,053,464 | A * | 9/1936 | Dalsheim | 150/105 |
| 2,131,382 | A * | 9/1938 | Lobel | 150/105 |
| 2,493,506 | A * | 1/1950 | Schwartzbard | 150/103 |
| 2,723,696 | A * | 11/1955 | Kase | 150/105 |
| 4,679,671 | A * | 7/1987 | Kobayashi | 190/115 |
| 4,754,790 | A * | 7/1988 | Meyers | 150/104 |
| 4,856,570 | A * | 8/1989 | Rushing et al. | 150/107 |
| 5,178,198 | A * | 1/1993 | Fitzgerald | 150/107 |
| 5,653,337 | A * | 8/1997 | Cirigliano | 206/373 |
| 5,692,660 | A * | 12/1997 | Stewart | 224/581 |
| 5,765,618 | A * | 6/1998 | Toledano | 150/107 |
| 6,102,569 | A * | 8/2000 | Wang | 383/104 |
| 6,994,132 | B2 * | 2/2006 | Antrobus | 150/107 |
| D543,026 | S * | 5/2007 | Gonzalez | D3/243 |
| 7,575,376 | B2 * | 8/2009 | Yu | 383/2 |
| 2007/0163689 | A1 * | 7/2007 | Pace et al. | 150/105 |
| 2008/0135143 | A1 * | 6/2008 | Zvirblis | 150/104 |

FOREIGN PATENT DOCUMENTS

| | | | |
|---|---|---|---|
| EP | 0487162 | A1 * | 5/1992 |
| FR | 2651651 | A1 * | 3/1991 |
| JP | 7111910 | * | 5/1995 |
| JP | 2006296560 | A * | 11/2006 |

* cited by examiner

*Primary Examiner*—Sue A Weaver
(74) *Attorney, Agent, or Firm*—Charles E. Baxley

(57) ABSTRACT

A reversible tote bag includes a bag portion, two pair of front brackets, two pair of rear brackets, and a pair of handles. The two pair of front brackets and the two pair of rear brackets have interior portions and exterior portions. The pair of handles are replaceably attached to the exterior portions of the two pair of front brackets and to the two pair of rear brackets, respectively, and when removed therefrom, the bag can be reversed, with the pair of handles then being placed onto the pair of previously interior portions that now become the exterior portions of the two pair of front brackets and the two pair of rear brackets.

10 Claims, 6 Drawing Sheets

REVERSIBLE TOTE BAG

1. BACKGROUND OF THE INVENTION

A. Field of the Invention

The embodiments of the present invention relate to a tote bag, and more particularly, the embodiments of the present invention relate to a reversible tote bag.

B. Description of the Prior Art

Numerous innovations for tote bags have been provided in the prior art. Even though these innovations may be suitable for the specific individual purposes to which they address, they each differ in structure, and/or operation, and/or purpose, from the embodiments of the present invention in that they do not teach a reversible tote bag.

2. SUMMARY OF THE INVENTION

Thus, an object of the embodiments of the present invention is to provide a reversible tote bag, which avoids the disadvantages of the prior art.

Briefly stated, another object of the embodiments of the present invention is to provide a reversible tote bag, including a bag portion, two pair of front brackets, two pair of rear brackets, and a pair of handles. The two pair of front brackets and the two pair of rear brackets have interior portions and exterior portions. The pair of handles are replaceably attached to the exterior portions of the two pair of front brackets and to the two pair of rear brackets, respectively, and when removed therefrom, the bag can be reversed, with the pair of handles then being placed onto the pair of previously interior portions that now become the exterior portions of the two pair of front brackets and the two pair of rear brackets.

The novel features considered characteristic of the embodiments of the present invention are set forth in the appended claims. The embodiments of the present invention themselves, however, both as to their construction and their method of operation together with additional objects and advantages thereof will be best understood from the following description of the specific embodiments when read and understood in connection with the accompanying drawing.

3. BRIEF DESCRIPTION OF THE DRAWING

The figures of the drawing are briefly described as follows.

4. LIST OF REFERENCE NUMERALS UTILIZED IN THE DRAWING

A. General

Figure 1:
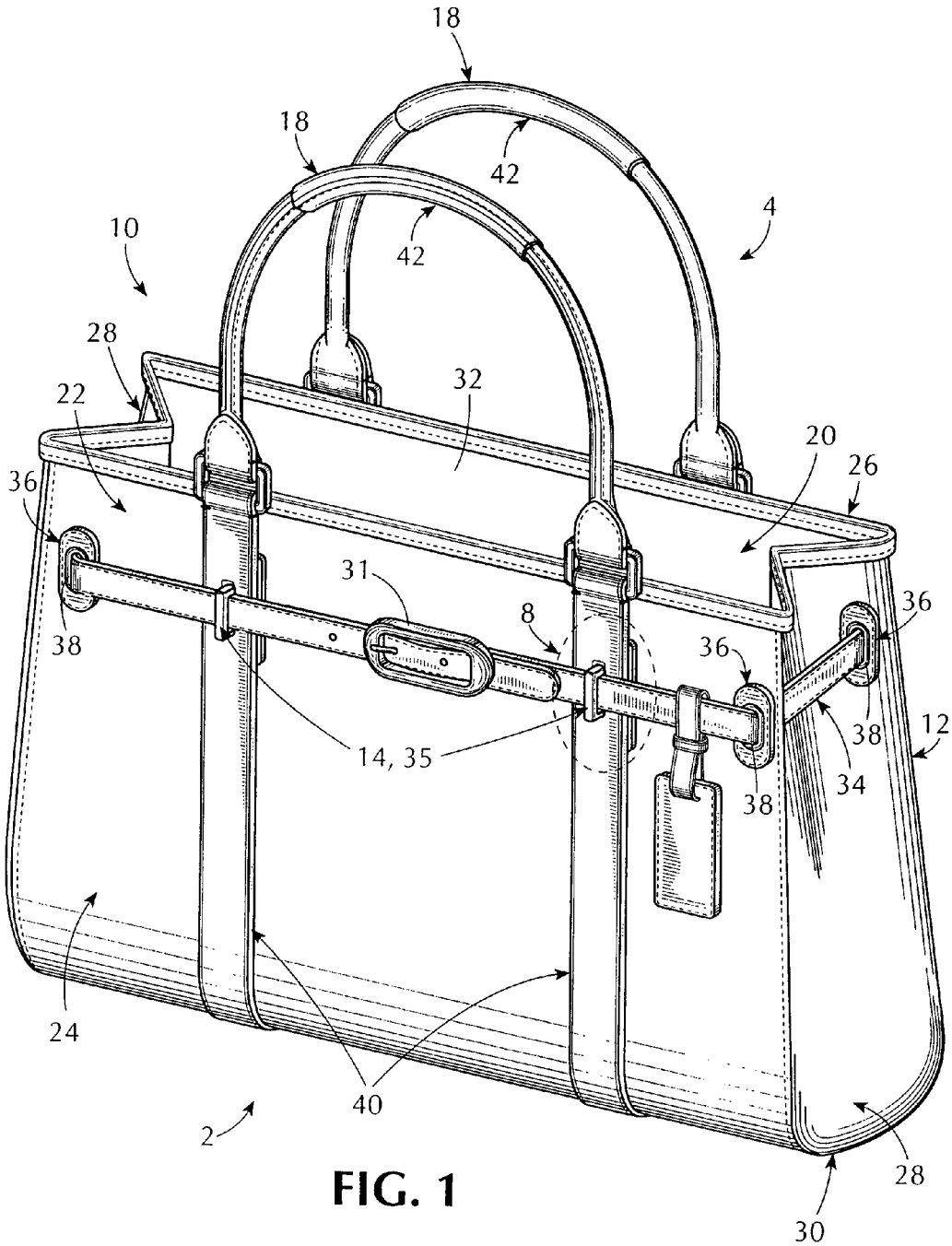
FIG. 1 is a diagrammatic perspective view of the reversible tote bag of the embodiments of the present invention.

10 reversible tote bag of embodiments of present invention

B. Overall Configuration

12 bag portion
14 two pair of front brackets
16 two pair of rear brackets
18 pair of handles
20 interior of bag portion 12
22 exterior of bag portion 12
24 front wall of bag portion 12
26 rear wall of bag portion 12
28 pair of gusseted side walls of bag portion 12
30 bottom wall of bag portion 12
31 buckle of enclosing peripheral strap 34
32 top of bag portion 12
33 interior portions of two pair of front brackets 14
34 enclosing peripheral strap
35 exterior portions of two pair of front brackets 14
36 eyelets of bag portion 12
37 interior portions of two pair of rear brackets 16
38 holes in bag portion 12
39 exterior portions of two pair of rear brackets 16
40 support straps of pair of handles 18
42 grabbing straps of pair of handles 18

C. Specific Configuration of Each Bracket of Two Pair of Front Brackets 14 and Two Pair of Rear Brackets 16

44 base of each bracket of two pair of front brackets 14 and two pair of rear brackets 16
46 loop of each bracket of two pair of front brackets 14 and two pair of rear brackets 16
48 through slots through support straps 40 of bag portion 12
50 pair of pockets

5. DETAILED DESCRIPTION OF THE PREFERRED EMBODIMENTS

A. General

Figure 2:
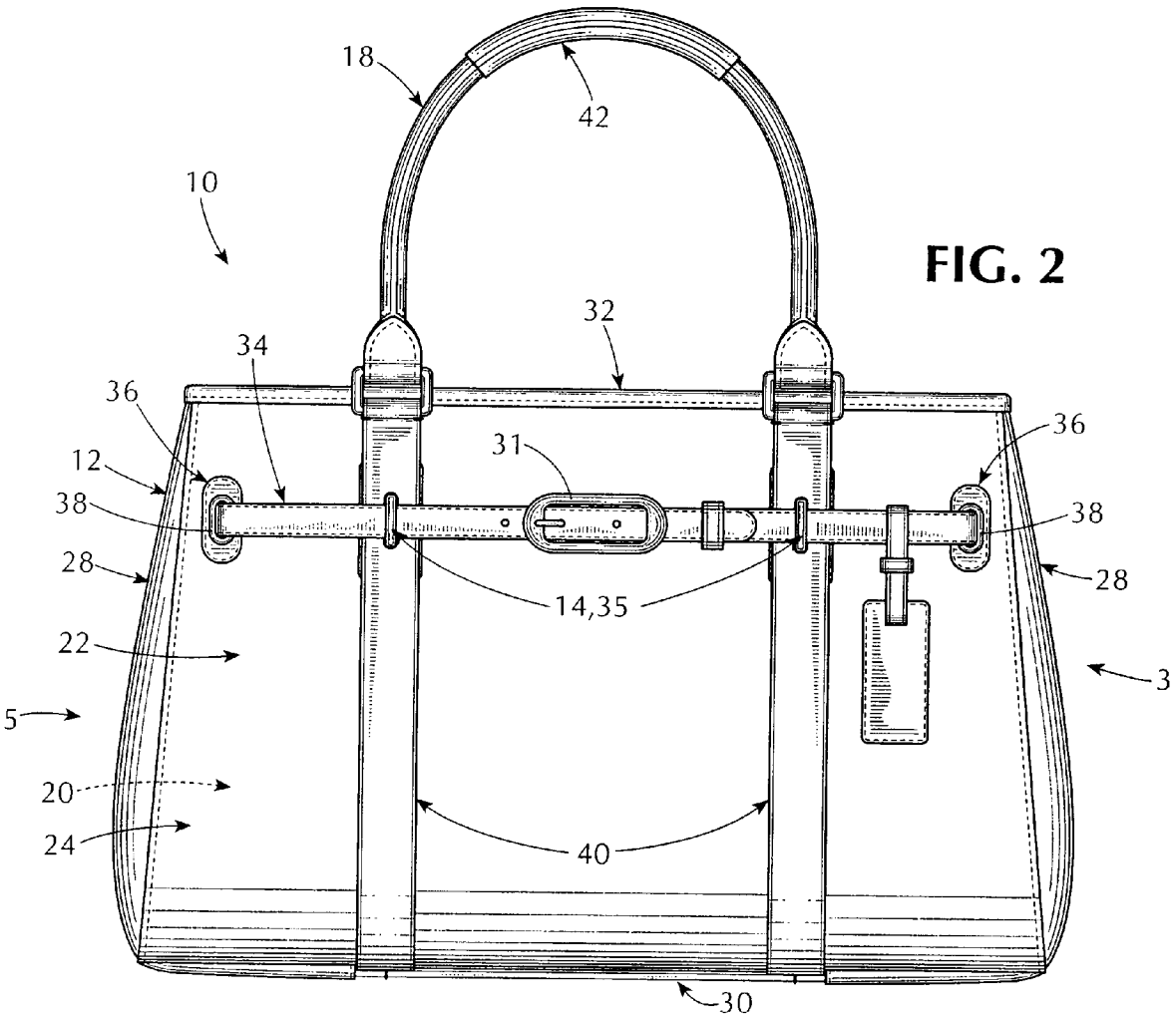
FIG. 2 is a diagrammatic front elevational view taken generally in the direction of ARROW 2 in FIG. 1.
Figure 5:
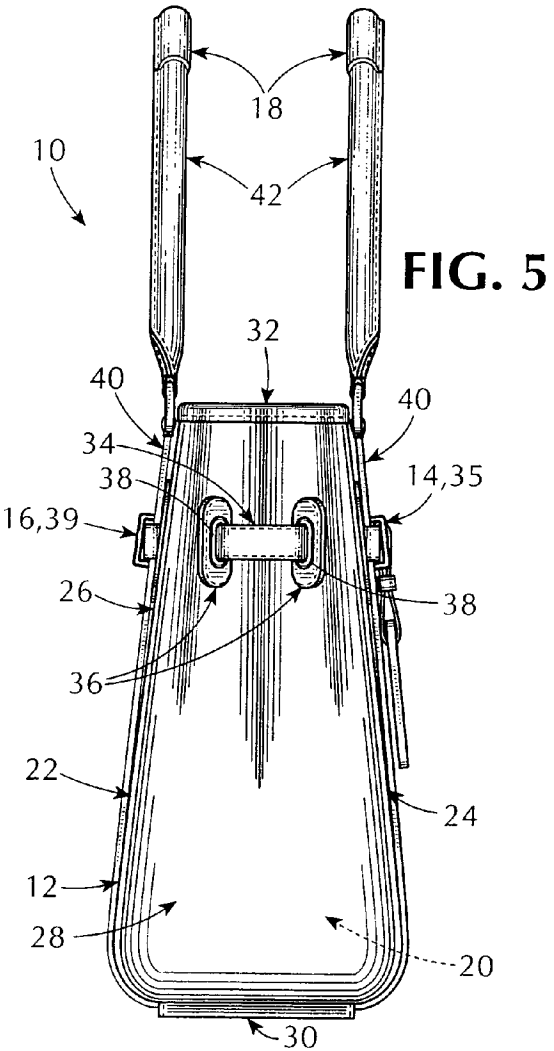
FIG. 5 is a diagrammatic left side elevational view taken generally in the direction of ARROW 5 in FIG. 2.
Figure 3:
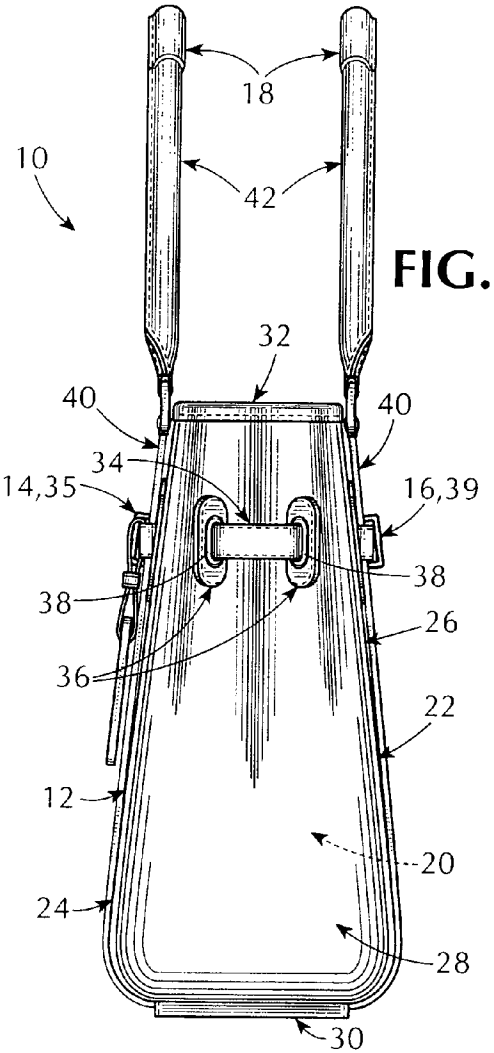
FIG. 3 is a diagrammatic right side elevational view taken generally in the direction of ARROW 3 in FIG. 2.
Figure 4:
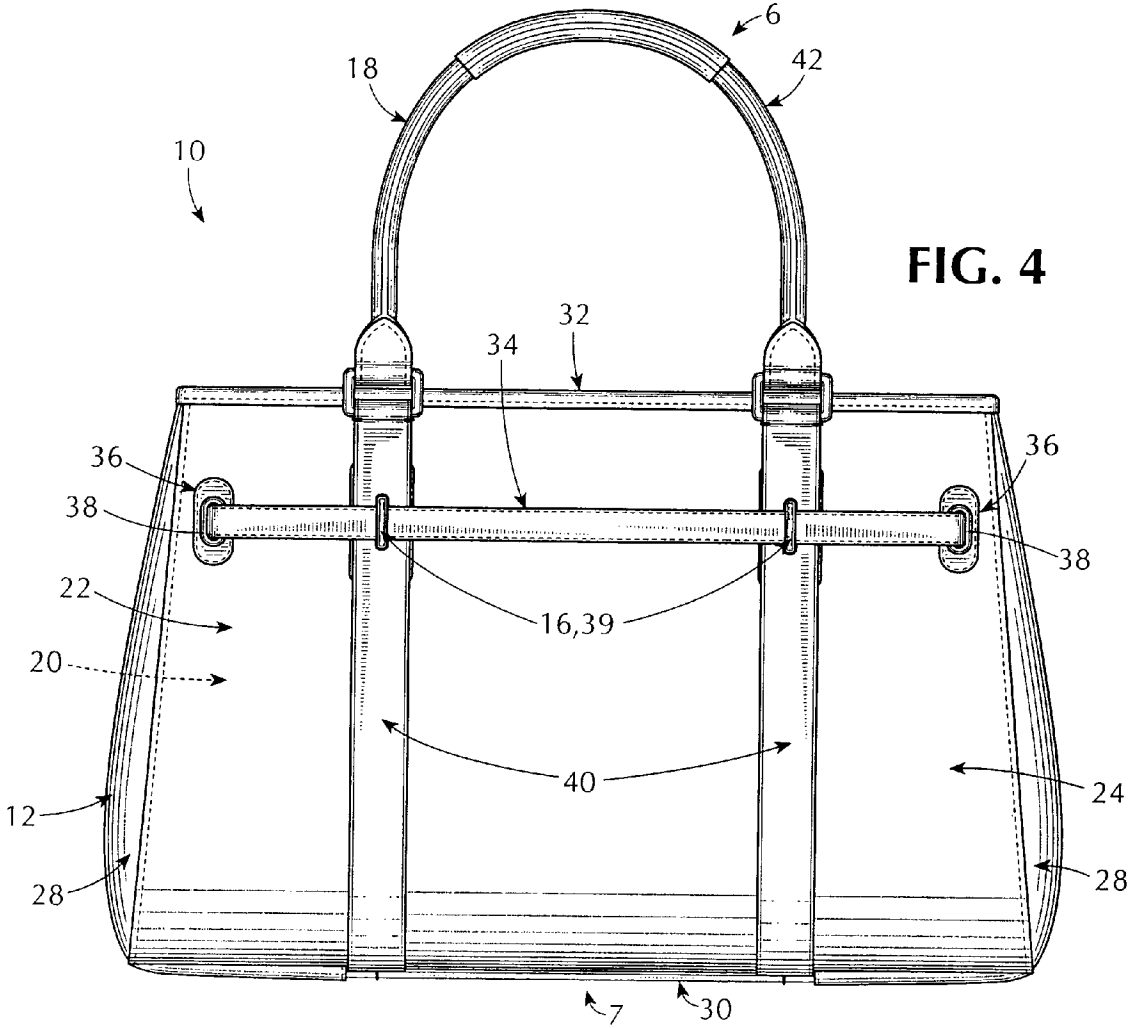
FIG. 4 is a diagrammatic rear elevational view taken generally in the direction of ARROW 4 in FIG. 1.

Referring now to the drawings, in which like numerals indicate like parts, and particularly to FIGS. 1-7, which are, respectively, a diagrammatic perspective view of the reversible tote bag of the embodiments of the present invention, a diagrammatic front elevational view taken generally in the direction of ARROW 2 in FIG. 1, a diagrammatic right side elevational view taken generally in the direction of ARROW 3 in FIG. 2, a diagrammatic rear elevational view taken generally in the direction of ARROW 4 in FIG. 1, a diagrammatic left side elevational view taken generally in the direction of ARROW 5 in FIG. 2, a diagrammatic top plan view taken generally in the direction of ARROW 6 in FIG. 4, and a diagrammatic bottom plan view taken generally in the direction of ARROW 7 in FIG. 4, the reversible tote bag of the embodiments of the present invention is shown generally at 10.

B. The Overall Configuration

The reversible tote bag 10 comprises a bag portion 12, two pair of front brackets 14, two pair of rear brackets 16, and a pair of handles 18. The bag portion 12 has an interior 20, an exterior 22, a front wall 24, a rear wall 26, a pair of gusseted side walls 28, a bottom wall 30, and a top 32. The front wall 24 of the bag portion 12 is connected to the rear wall 26 of the bag portion 12 by the pair of gusseted side walls 28 of the bag portion 12 and by the bottom wall 30 of the bag portion 12, while the top 32 of the bag portion 12 is open to selectively access the interior 20 of the bag portion 12.

The two pair of front brackets 14 are disposed on the front wall 24 of the bag portion 12, and have interior portions 33 extending towards the interior 20 of the bag portion 12 and exterior portions 35 extending towards the exterior 22 of the bag portion 12, respectively.

The two pair of rear brackets 16 are disposed on the rear wall 26 of the bag portion 12, and have interior portions 37 extending towards the interior 20 of the bag portion 12 and exterior portions 39 extending towards the exterior 22 of the bag portion 12, respectively.

The pair of handles 18 are replaceably attached to the two pair of front brackets 14 and to the two pair of rear brackets 16, respectively, and when removed therefrom, the bag portion 12 can be reversed, with the pair of handles 18 then being placed onto the pair of previously interior portions 33, 37 which now become the exterior portions 35, 39 of the two pair of front brackets 14 and the two pair of rear brackets 16.

The reversible tote bag 10 further comprises an enclosing peripheral strap 34. The enclosing peripheral strap 34 weaves replaceably through the bag portion 12 and replaceably through the two pair of front brackets 14 and the two pair of rear brackets 16 by way of a buckle 31, and is external to the pair of handles 18, to thereby maintain the pair of handles 18 in engagement with the two pair of front brackets 14 and with the two pair of rear brackets 16.

The bag portion 12 further has eyelets 36 surrounding holes 38 therein. The enclosing peripheral strap 34 weaves replaceably through the eyelets 36 of the bag portion 12.

The pair of handles 18 have support straps 40 and grabbing straps 42. The support straps 40 of the pair of handles 18 extend from the bottom wall 30 of the bag portion, freely over the front wall 24 of the bag portion 12 and the rear wall 26 of the bag portion 12, respectively, to freely receive in slots therein the two pair of front brackets 14 and the two pair of rear brackets 16, respectively, and hingedly terminate in the grabbing straps 42 of the pair of handles 18, respectively, at the top 32 of the bag portion 12.

C. The Specific Configuration of Each Bracket of the Two Pair of Front Brackets 14 and the Two Pair of Rear Brackets 16

Figure 8:
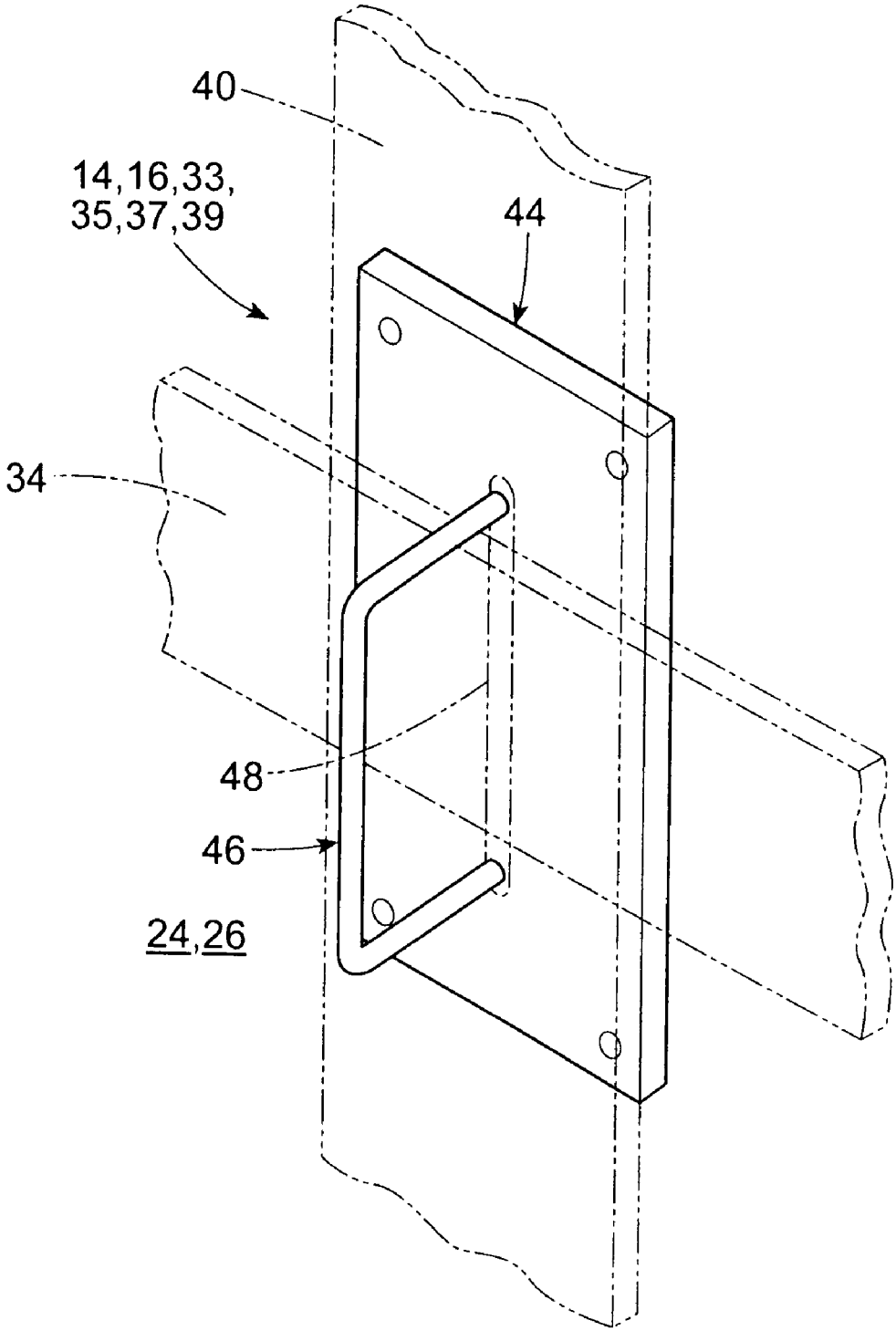
FIG. 8 is a diagrammatic perspective view of the area generally enclosed by the dotted curve identified by ARROW 8 in FIG. 1 of a bracket of the reversible tote bag of the embodiments of the present invention shown in FIGS. 1-7.

The specific configuration of each bracket of the two pair of front brackets 14 and the two pair of rear brackets 16 can best be seen in FIG. 8, which is a diagrammatic perspective view of the area generally enclosed by the dotted curve identified by ARROW 8 in FIG. 1 of a bracket of the reversible tote bag of the embodiments of the present invention shown in FIGS. 1-7, and as such, will be discussed with reference thereto.

Each bracket of the two pair of front brackets 14 and the two pair of rear brackets 16 has a base 44 and a loop 46. The loop 46 of each bracket of the two pair of front brackets 14 and the two pair of rear brackets 16 extends from the base 44 of an associated bracket 14, 16.

The enclosing peripheral strap 34 weaves replaceably through the loop 46 of each bracket of the two pair of front brackets 14 and the two pair of rear brackets 16, external to the support straps 40 of the pair of handles 18 that freely receive the two pair of front brackets 14 and the two pair of rear brackets 16, respectively, via through slots 48, to thereby maintain the pair of handles 18 in engagement with the two pair of front brackets 14 and with the two pair of rear brackets 16.

Figure 6:
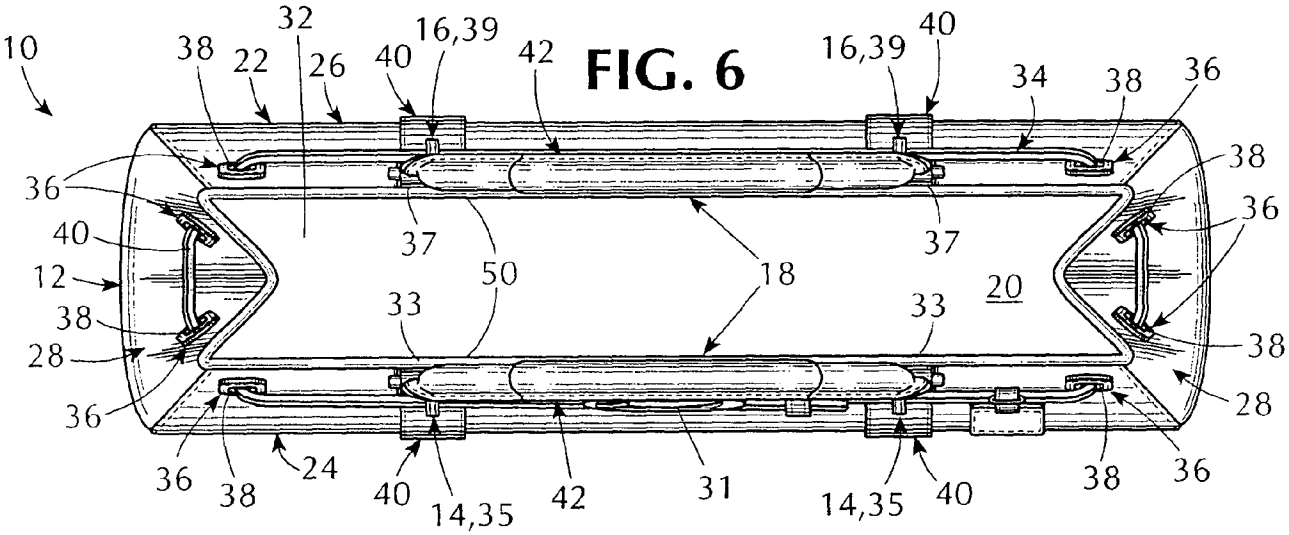
FIG. 6 is a diagrammatic top plan view taken generally in the direction of ARROW 6 in FIG. 4.
Figure 7:
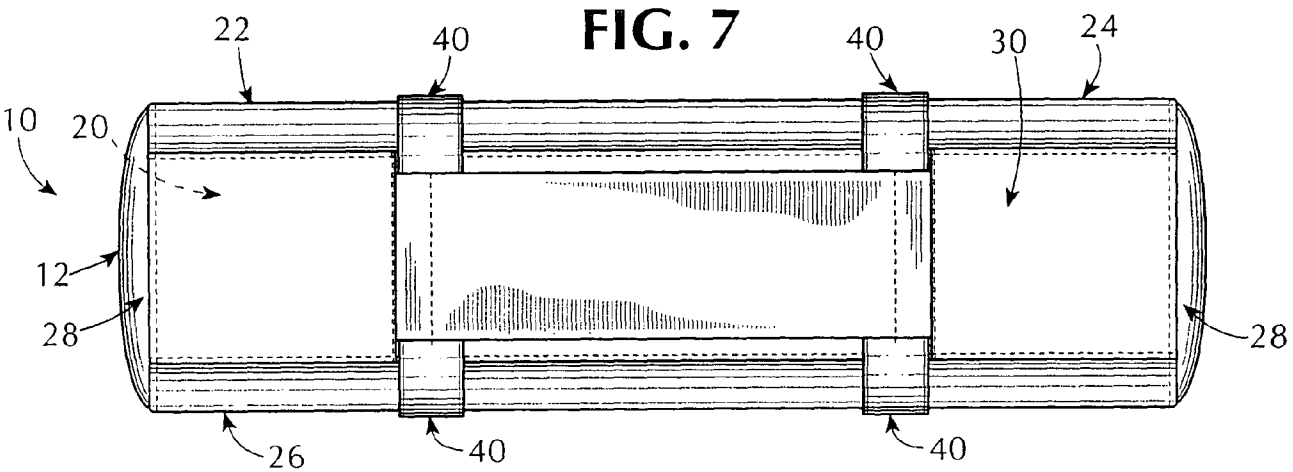
FIG. 7 is a diagrammatic bottom plan view taken generally in the direction of ARROW 7 in FIG. 4.

As shown in FIG. 6, the reversible tote bag 10 further comprises a pair of pockets 50. Each pocket 50 extends in the interior 20 of the bag portion 12, replaceably across the interior portion 33 of the two pair of front brackets 14 and the interior portion 39 of the two pair of back brackets 16, respectively, so as to allow the pair of pockets 50 to be removed and relocated when the bag portion 12 is reversed.

D. The Conclusions

It will be understood that each of the elements described above or two or more together may also find a useful application in other types of constructions differing from the types described above.

While the embodiments of the present invention have been illustrated and described as embodied in a reversible tote bag, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt it for various applications without omitting features that from the standpoint of prior art fairly constitute characteristics of the generic or specific aspects of the embodiments of the present invention.

The invention claimed is:

1. A reversible tote bag, comprising:

a) a bag portion;

b) two pair of front brackets;

c) two pair of rear brackets;

d) a pair of handles; and e) an enclosing peripheral strap;

wherein said bag portion has:

a) an interior;

b) an exterior;

c) a front wall;

d) a rear wall;

e) a pair of gusseted side walls;

f) a bottom wall; and g) a top;

wherein said front wall of said bag portion is connected to said rear wall of said bag portion by said pair of gusseted side walls of said bag portion and said bottom wall of said bag portion;

wherein said top of said bag portion is open to selectively access said interior of said bag portion;

wherein said two pair of front brackets are disposed on said front wall of said bag portion;

wherein said two pair of front brackets have:

a) interior portions extending towards said interior of said bag portion; and b) exterior portions extending towards said exterior of said bag portion;

wherein said two pair of rear brackets are disposed on said rear wall of said bag portion;

wherein said two pair of rear brackets have:

a) interior portions extending towards said interior of said bag portion; and b) exterior portions extending towards said exterior of said bag portion;

wherein said pair of handles are replaceably attached to said two pair of front brackets and said two pair of rear brackets, respectively, and when removed therefrom, said bag portion can be reversed, with said pair of handles then being placed onto said pair of previously interior portions which now become said exterior portions of said two pair of front brackets and said two pair of rear brackets; and wherein said enclosing peripheral strap weaves replaceably through said bag portion and replaceably through said two pair of front brackets and said two pair of rear brackets by way of a buckle, and is external to said pair of handles, to thereby maintain said pair of handles in engagement with said two pair of front brackets and with said two pair of rear brackets.

2. The bag of claim 1, wherein said bag portion has eyelets surrounding holes therein.

3. The bag of claim 2, wherein said enclosing peripheral strap weaves replaceably through said eyelets of said bag portion.

4. The bag of claim 1, wherein said pair of handles have;

a) support straps; and b) grabbing straps.

5. The bag of claim 4, wherein said support straps of said pair of handles extend from said bottom wall of said bag portion, freely over said front wall of said bag portion and said rear wall of said bag portion, respectively, to freely receive in slots therein said two pair of front brackets and said two pair of rear brackets, respectively, and hingedly terminate in said grabbing straps of said pair of handles, respectively, at said top of said bag portion.

6. The bag of claim 5, wherein each bracket of said two pair of front brackets and said two pair of rear brackets has:

a) a base; and b) a loop.

7. The bag of claim 6, wherein said loop of each bracket of said two pair of front brackets and said two pair of rear brackets extends from said base of an associated bracket.

8. The bag of claim 7, wherein said enclosing peripheral strap weaves replaceably through said loop of each bracket of said two pair of front brackets and said two pair of rear brackets, external to said support straps of said pair of handles that freely receive said two pair of front brackets and said two pair of rear brackets, respectively, via through slots, to thereby maintain said pair of handles in engagement with said two pair of front brackets and said two pair of rear brackets.

9. The bag of claim 1, further comprising pockets.

10. The bag of claim 9, wherein each pocket extends in said interior of said bag portion, replaceably across said interior portions of said two pair of front brackets and said interior portion of said two pair of rear brackets, respectively, so as to allow said pair of pockets to be removed and relocated when said bag portion is reversed.

* * * * *